US010866539B2

(12) United States Patent
Taniguchi et al.

(10) Patent No.: US 10,866,539 B2
(45) Date of Patent: Dec. 15, 2020

(54) UNIT HAVING A DEVELOPER CONVEYING MEMBER AND A FILTER FOR A CHAMBER

(71) Applicant: CANON KABUSHIKI KAISHA, Tokyo (JP)

(72) Inventors: Hisashi Taniguchi, Suntou-gun (JP); Takayoshi Kihara, Mishima (JP); Shuhei Kawasaki, Susono (JP); Shota Nakamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/802,999

(22) Filed: Nov. 3, 2017

(65) Prior Publication Data

US 2018/0129150 A1 May 10, 2018

(30) Foreign Application Priority Data

Nov. 9, 2016 (JP) ..... 2016-218761
Oct. 3, 2017 (JP) ..... 2017-193639

(51) Int. Cl.
*G03G 15/08* (2006.01)
*G03G 21/18* (2006.01)
*G03G 21/20* (2006.01)

(52) U.S. Cl.
CPC ..... *G03G 15/0898* (2013.01); *G03G 15/0891* (2013.01); *G03G 21/1814* (2013.01); *G03G 21/206* (2013.01); *G03G 15/0887* (2013.01)

(58) Field of Classification Search
CPC ..... G03G 15/0891; G03G 15/0898; G03G 21/1814
See application file for complete search history.

(56) References Cited

U.S. PATENT DOCUMENTS 4,583,112 A * 4/1986 Morano ..... G03G 15/0898 399/103
4,666,282 A * 5/1987 Rowe ..... G03G 15/0898 15/301

(Continued)

FOREIGN PATENT DOCUMENTS

CN 101950136 A 1/2011
JP 61145570 A * 7/1986 ..... G03G 15/0898

(Continued)

OTHER PUBLICATIONS

English machine translation of JP 2016-035545.*

(Continued)

*Primary Examiner* — Arlene Heredia
(74) *Attorney, Agent, or Firm* — Venable LLP

(57) ABSTRACT

A unit includes: a conveying member that conveys developer; a frame that stores the developer and includes a first chamber storing the conveying member, a second chamber, a first opening connecting the first chamber and the second chamber, and through which the developer is passed, and a second opening connecting the interior of the second chamber and the exterior of the frame in an orthogonal direction that is orthogonal to a direction of a rotation axis line of the conveying member; and a filter that allows air to pass the second opening and restricts the developer from passing the second opening, and is fixed to the frame, wherein the frame is displaceable with respect to an apparatus main body in a state where the unit is attached to the apparatus main body, and the filter is displaced with respect to the apparatus main body by the displacement of the frame.

38 Claims, 8 Drawing Sheets

(56) References Cited

U.S. PATENT DOCUMENTS

| | | | | |
|---|---|---|---|---|
| 5,465,139 | A * | 11/1995 | Kimura | G03G 15/0822 399/260 |
| 5,887,227 | A * | 3/1999 | Kawai | G03G 15/0126 399/119 |
| 6,823,153 | B2 * | 11/2004 | Ueno | G03G 15/234 399/103 |
| 6,978,100 | B2 | 12/2005 | Yasui et al. | |
| 7,139,502 | B2 * | 11/2006 | Koishi | G03G 21/1814 399/93 |
| 7,155,137 | B2 | 12/2006 | Yasui et al. | |
| 7,251,435 | B2 * | 7/2007 | Ohgoshi | G03G 15/0817 399/103 |
| 7,257,353 | B2 | 8/2007 | Kawai et al. | |
| 7,512,373 | B2 * | 3/2009 | Shimizu | G03G 15/0872 399/358 |
| 7,792,440 | B2 * | 9/2010 | Takano | G03G 15/0891 399/249 |
| 8,744,321 | B2 * | 6/2014 | Kubota | G03G 21/1676 399/263 |
| 9,501,032 | B2 | 11/2016 | Kawasaki et al. | |
| 2009/0297213 | A1 | 12/2009 | Satomura | |
| 2010/0316413 | A1 * | 12/2010 | Murasaki | G03G 15/0194 399/228 |
| 2011/0008068 | A1 | 1/2011 | Kunihiro et al. | |
| 2011/0103827 | A1 | 5/2011 | Uneme et al. | |
| 2011/0123205 | A1 | 5/2011 | Satomura | |
| 2011/0311279 | A1 | 12/2011 | Okazaki et al. | |
| 2013/0243498 | A1 | 9/2013 | Taniguchi et al. | |
| 2016/0026119 | A1 | 1/2016 | Ohashi et al. | |
| 2016/0252877 | A1 | 9/2016 | Nakamura et al. | |
| 2016/0282763 | A1 | 9/2016 | Maeshima et al. | |
| 2017/0242392 | A1 * | 8/2017 | Sakai | G03G 21/181 |
| 2018/0081299 | A1 * | 3/2018 | Okuno | G03G 15/0877 |
| 2018/0120731 | A1 * | 5/2018 | Nakamura | G03G 15/0808 |

FOREIGN PATENT DOCUMENTS

| | | | |
|---|---|---|---|
| JP | 2003-270939 | A | 9/2003 |
| JP | 2004-138934 | A | 5/2004 |
| JP | 2008-216467 | A | 9/2008 |
| JP | 2009-036875 | A | 2/2009 |
| JP | 2009-053274 | A | 3/2009 |
| JP | 2009-122509 | A | 6/2009 |
| JP | 2009-288324 | A | 12/2009 |
| JP | 2010-107899 | A | 5/2010 |
| JP | 2010-217426 | A | 9/2010 |
| JP | 2010-237635 | A | 10/2010 |
| JP | 2011-112826 | A | 6/2011 |
| JP | 2011-118357 | A | 6/2011 |
| JP | 4790676 | B2 | 10/2011 |
| JP | 2012-003193 | A | 1/2012 |
| JP | 2013-195451 | A | 9/2013 |
| JP | 2013-210436 | A | 10/2013 |
| JP | 2016-035545 | A | 3/2016 |
| WO | 2016/136241 | A1 | 1/2016 |
| WO | 2016/051702 | A1 | 4/2016 |

OTHER PUBLICATIONS

English machine translation of JP 2010-237635.*

Machine translation into English of JP 2010-237635_Description (Year: 2010).*

Office Action in Singaore Patent Application No. 10201709190V, dated Mar. 1, 2018.

Extended Search Report in European Patent Application No. 17 200 587.8, dated Jun. 18, 2018.

May 27, 2020 Office Action Chinese Patent Application No. 201711075983.5 (with English translation).

* cited by examiner

UNIT HAVING A DEVELOPER CONVEYING MEMBER AND A FILTER FOR A CHAMBER

BACKGROUND OF THE INVENTION

Field of the Invention

The present invention relates to an electrophotographic image forming apparatus.

Description of the Related Art

As a process cartridge type image forming apparatus (e.g. copier, printer), a configuration separated into a plurality of units, such as a photosensitive member unit which includes a photosensitive drum, a developing unit which includes a developing means, and a toner unit which supplies toner (developer), is known. Among these units, the developing unit (developing apparatus) in the image forming apparatus normally includes a developer container, a developing roller which is a developer bearing member disposed at the developing opening of the developer container, and a developing blade which extends toward the developing roller to control the layer thickness of toner. On the other edge of the developing opening in the longitudinal direction, a sheet member, which extends toward the developing roller, is installed in order to prevent toner leakage inside the developer container through the developing opening and gaps with the developing roller. Further, on both ends of the developing opening in the longitudinal direction, seal members to fill the gaps with the developing roller, the developing blade and the sheet member are installed.

In such a developing unit, the internal pressure may rise due to various factors. In this case, toner more easily leaks out through the sheet member and the seal member which seal the toner, and this is because of the pressure difference between the inside and outside of the developing unit. To prevent toner leakage by reducing the pressure inside the developing unit, a configuration of disposing a ventilation opening and a filter member in a developing frame has been proposed (see Japanese Patent No. 5751779 and Japanese Patent No. 4790676).

In the above mentioned developing unit, an example of a configuration is disclosed that places importance on first-print-out-time (FPOT), whereby the developing chamber, in which the developing roller is installed, is disposed above the toner storing member, and a sheet type toner conveying member is rotatably installed in the toner storing member. In such a configuration, the toner conveying member may convey air that exists in the toner storing chamber, along with toner, and may increase the internal pressure of the developing chamber considerably. Furthermore, lately as printers become faster with a longer life span, supplying more toner to the developing chamber is demanded, and for this, an increase in the rotation speed of the toner conveying member and an increase in the thickness of the conveying unit are required. This may further increase the internal pressure of the developing chamber, and cause toner leakage through the sheet member which is in light contact, and the end seal member which has a configuration that easily generates a gap. Moreover, if the printer is used in a certain position for a long time, toner may directly contact the filter member when toner is supplied, or toner lifted up by the driving of the developing toner or the toner supplying roller may adhere to the filter member, causing the filter member to clog. This may cause a drop in the ventilation capability of the filter member, and diminish the effect of suppressing the internal pressure of the developing chamber.

SUMMARY OF THE INVENTION

An object of the present invention is to provide a technique to suppress the rise of the internal pressure of a unit in which the developer is stored.

To achieve the above object, a unit of the present invention is a unit configured to be detachable from an apparatus main body of an image forming apparatus, the unit comprising:

a conveying member for conveying developer that is deformable and conveys developer when being rotated and released from deformation;

a frame that stores the developer and includes a first chamber that stores the conveying member, a second chamber, a first opening which connects the first chamber and the second chamber, and through which the developer conveyed from the first chamber to the second chamber is passed, and a second opening which connects the interior of the second chamber and the exterior of the frame in an orthogonal direction that is orthogonal to a direction of a rotation axis line of the conveying member; and a filter that allows air to pass the second opening and restricts the developer from passing the second opening, and is fixed to the frame, wherein the frame is displaceable with respect to the apparatus main body in a state where the unit is attached to the apparatus main body, and the filter is displaced with respect to the apparatus main body by the displacement of the frame.

To achieve the above object, a processing cartridge of the present invention is a process cartridge configured to be detachable from an apparatus main body of an image forming apparatus, the process cartridge comprising:

the unit which is used as a first unit including a developer bearing member; and a second unit including an image bearing member, wherein relative positions of the first unit and the second unit can be changed so that the developer bearing member and the image bearing member can be contacted or separated.

To achieve the above object, an image forming apparatus of the present invention is an image forming apparatus, comprising:

an apparatus main body that includes an image bearing member;

the unit that includes a developer bearing member, and is detachable from the apparatus main body; and a contact/separation mechanism that displaces the unit in the interior of the apparatus main body so that the developer bearing member can be in a contact state where the developer bearing member contacts the image bearing member, or in a separated state where the developer bearing member is separated from the image bearing member.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

The present invention is applicable to an electrophotographic image forming apparatus in which a developing unit, a photosensitive member unit (also called a "cleaning unit"), a process cartridge and the like are detachable from the apparatus main body. Here the electrophotographic image forming apparatus (hereafter also called "image forming apparatus") forms an image on a recording material (recording medium) using an electrophotographic image forming system. Examples of the image forming apparatus include: a copier, a printer (e.g. laser beam printer, LED printer), a facsimile machine, a wordprocessor, and an integrated machine thereof (a multifunction printer). The apparatus main body refers to a component of the image forming apparatus excluding the above units and cartridges.

Electrophotographic Image Forming Apparatus

Figure 1:
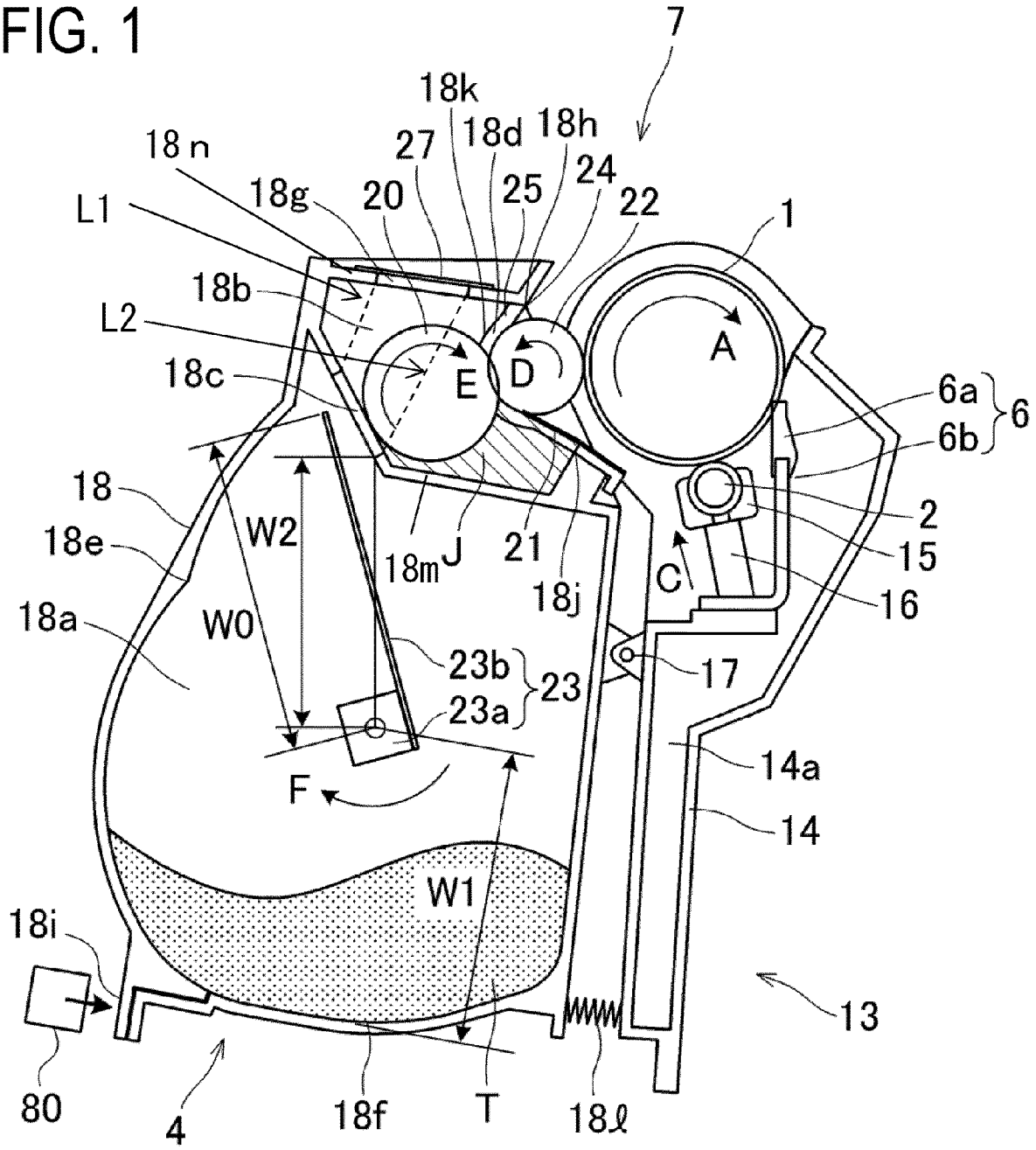
FIG. 1 is a cross-sectional view of a process cartridge according to this invention.
Figure 2:
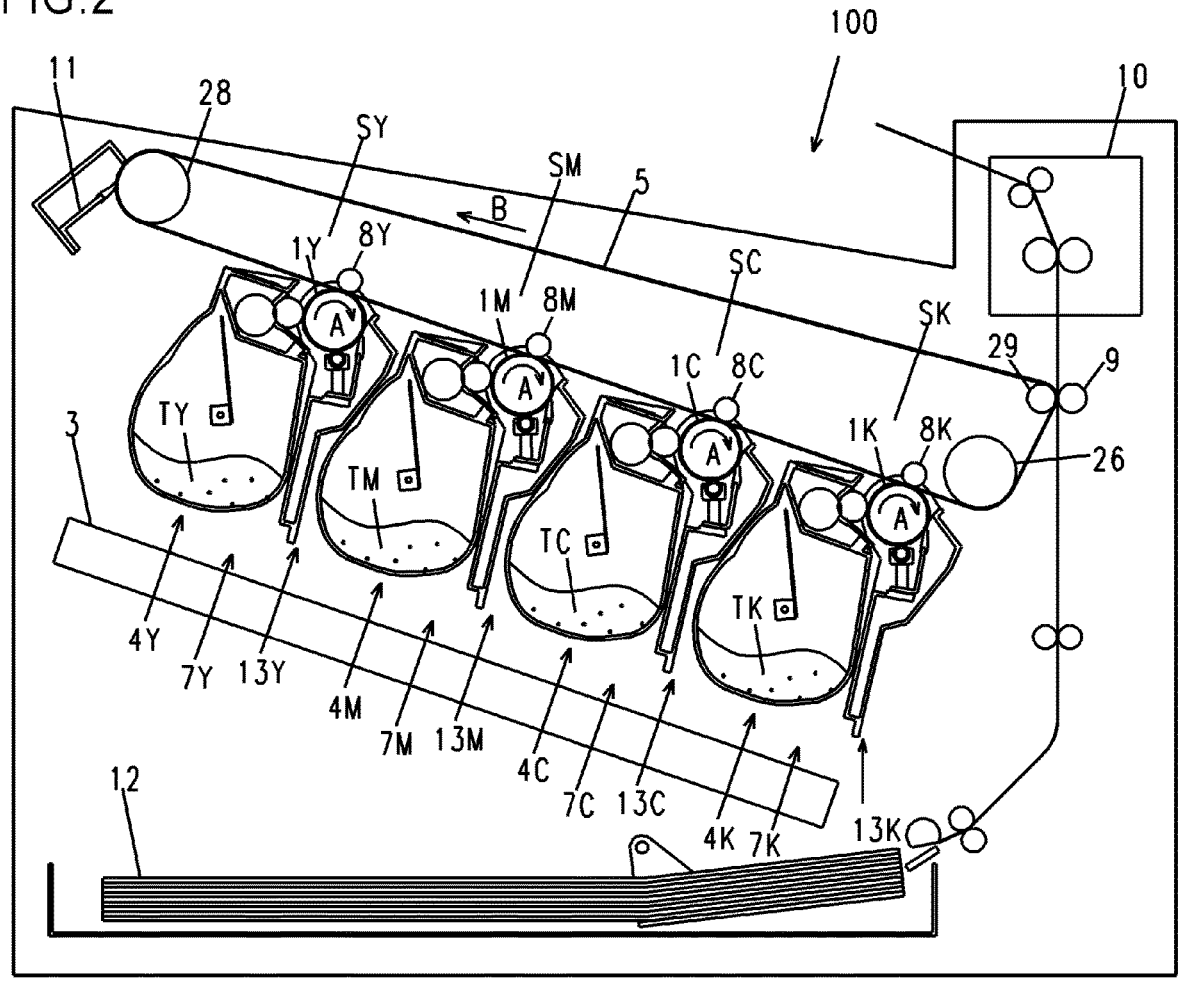
FIG. 2 is a schematic cross-sectional view of an image forming apparatus and process cartridges according to this invention.
Figure 3:
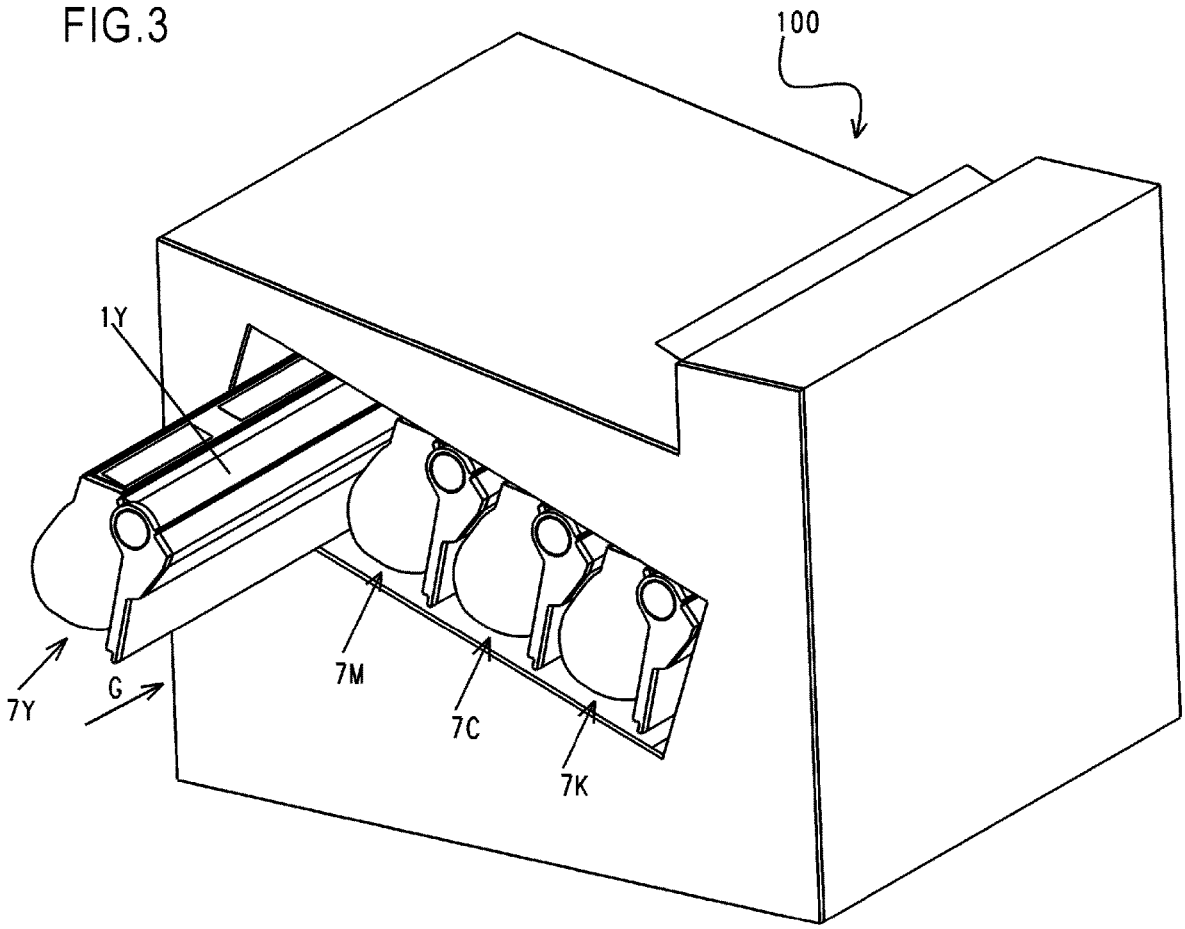
FIG. 3 is a perspective view of the image forming apparatus and process cartridges according to this invention.

A configuration of an electrophotographic image forming apparatus (image forming apparatus) according to an example of the present invention will be described with reference to FIGS. 1 to 3. FIG. 1 is a schematic cross-sectional view of a process cartridge 7. FIG. 2 is a schematic cross-sectional view of the image forming apparatus 100 according to this example. FIG. 3 is a perspective view depicting a state of process cartridges 7 which are installed in the apparatus main body of the image forming apparatus 100. The image forming apparatus 100 has a plurality of image forming units, which are a first, second, third and fourth image forming units SY, SM, SC and SK to form images having yellow (Y), magenta (M), cyan (C) and black (K) colors respectively. In this example, the configuration and operation of the first to fourth image forming units are essentially the same, except that the color of the image to be formed is different. Therefore in the following, the image forming unit is described with omitting Y, M, C and K unless a distinction is necessary.

The image forming apparatus 100 has four photosensitive drums 1 (1Y, 1M, 1C, 1K) as the image bearing members. The photosensitive drum 1 rotates in the arrow A direction, as indicated in FIG. 1. Around the photosensitive drum 1, a charging roller 2 and a scanner unit (exposing apparatus) 3 are disposed. The charging roller 2 here is a charging unit to evenly charge the surface of the photosensitive drum 1. The scanner unit 3 is an exposing unit to form an electrostatic image (electrostatic latent image) on the photosensitive drum 1 by irradiating a laser based on the image information. Around the photosensitive drum 1, a developing apparatus (hereafter called "developing unit") 4 (4Y, 4M, 4C, 4K) and a cleaning blade 6 (6Y, 6M, 6C, 6K), which is a cleaning unit, are disposed. An intermediate transfer belt 5, which is an intermediate transfer member, to transfer a toner image (developer image) on the photosensitive drum 1 to a recording material 12, is disposed so as to face the four photosensitive drums 1. The photosensitive drum 1, a charging roller 2, and a cleaning blade 6 constitute a photosensitive member unit 13 (13Y, 13M, 13C, 13K) having a removed developer storing portion (hereafter called a "waste toner storing portion") 14*a* (14*a*Y, 14*a*M, 14*a*C, 14*a*K). In the waste toner storing portion 14*a*, untransferred toner (waste toner), which remained on the photosensitive drum 1 after the toner image is transferred to the recording material 12, and was removed from the photosensitive drum 1 by the cleaning blade 6, is stored.

The developing unit 4 performs contact development by contacting a developing roller 22, which is a developer bearing member to carry toner (developer), on the photosensitive drum 1. For the toner, a non-magnetic one component developer is stored. The developing unit 4 and the photosensitive member unit 13 are integrated to a process cartridge 7. The process cartridge 7 is detachable from the main body of the image forming apparatus 100 via an inserting unit, such as an inserting guide and a positioning member (not illustrated), disposed in the main body of the image forming apparatus 100. In this example, the process cartridge 7 can be inserted into the main body of the image forming apparatus 100 in the arrow G direction in FIG. 3, which is the axis line direction of the photosensitive drum 1. The shape of the process cartridge 7 for each color is identical, and in the process cartridge 7 for each color, toner T (TY, TM, TC, TK) of each yellow (Y), magenta (M), cyan (C) and black (K) color is stored respectively.

The intermediate transfer belt 5 contacts all the photosensitive drums 1, and rotates in the arrow B direction in FIG. 2. The intermediate transfer belt 5 is wound around a plurality of supporting members (driver roller 26, secondary transfer counter roller 29, and driven roller 28). Four primary transfer rollers 8 (8Y, 8M, 8C, 8K), which are primary transfer units, are disposed in parallel on the inner surface side of the intermediate transfer belt 5, so as to face each photosensitive drum 1. Further, a secondary transfer roller 9, which is a secondary transfer unit, is disposed on the outer surface side of the intermediate transfer belt 5 at a position facing the secondary transfer counter roller 29.

Process Cartridge

A general configuration of the process cartridge 7 of this example will be described with reference to FIG. 1. The developing unit 4 has a developing frame 18 which supports various composing elements in the developing unit 4. In the developing unit 4, the developing roller 22, which is a developer bearing member, is disposed so as to contact the photosensitive drum 1, and rotate in the arrow D direction in FIG. 1 (counterclockwise). Both ends of the developing roller 22, in the longitudinal direction (rotation axis line direction), are rotatably supported by the developing frame 18 via bearings. The developing frame 18 includes a developer storing chamber (hereafter called "toner storing chamber") (first chamber) 18*a* as the developer storing portion, a developing chamber (second chamber) 18*b*, and a developer supply opening (first opening) (hereafter called "toner supply opening") 18*c*. In the developing chamber 18*b*, the developing roller 22 is disposed. The developer supply opening 18*c* connects the toner storing chamber 18*a* and the developing chamber 18*b*. The developer supply opening 18*c* is formed at a partition portion (partition portion 18*m* in FIG. 1), which separates the toner storing chamber 18*a* and the developing chamber 18*b*. In this example, the developing chamber 18*b* is located above the toner storing chamber 18*a*. In the developing chamber 18*b*, a toner supply roller 20, that is, a supply member which contacts the developing roller 22 and rotates in the arrow E direction, and a developing blade 21, that is, a developer controlling member to control the toner layer on the developing roller 22, are disposed. The developing blade 21 contacts the surface of the developing roller 22, as illustrated in FIG. 1.

Further, as illustrated in FIG. 1, the developing roller 22 and the toner supply roller 20 rotate such that the surface of the developing roller 22 and the surface of the toner supply roller 20 move in the same direction at a mutually contacting portion. In other words, when viewing from the direction along the rotation axis line of the developing roller 22 or the rotation axis line of the toner supply roller 20, the rotation direction of the developing roller 22 and the rotation direction of the toner supply roller 20 are the opposite from each other.

In the toner storing chamber 18*a* of the developing frame 18, a stirring member (conveying member) 23, which stirs the stored toner T, allows the toner to flow into the developing chamber 18*b* via the toner supply opening 18*c*, and then conveys the toner to the toner supply roller 20, is disposed. The stirring member 23 includes a rotation shaft 23*a* disposed in parallel with the rotation axis direction of the developing roller 22, and a stirring sheet 23*b*, which is a flexible sheet member of which one end is installed in the rotation shaft 23*a*, stirs and conveys the toner. In other words, the directions of the rotation axis line of the stirring member 23 and the rotation axis line of the stirring sheet 23*b* are parallel with the direction of the rotation axis line of the developing roller 22, and the center of the rotation shaft 23*a* is the rotation axis lines of the stirring member 23 and the stirring sheet 23*b*.

The photosensitive member unit 13 includes a cleaning frame 14, which is a frame to support various composing elements in the photosensitive member unit 13. In the cleaning frame 14, the photosensitive drum 1 is installed so as to be rotatable in the arrow A direction (clockwise) in FIG. 1 via a bearing member. Further, in the cleaning frame 14, a charging roller bearing 15 is installed along the line passing through the rotation center of the charging roller 2 and the rotation center of the photosensitive drum 1. Here the charging roller bearing 15 is installed to be movable in the arrow C direction in FIG. 1. The charging roller 2 is rotatably installed on the charging roller bearing 15. The charging roller bearing 15 is biased by a charging roller pressurizing spring 16, which is a biasing unit, so as to press the charging roller 2 against the photosensitive drum 1. An elastic member 6*a* to remove the untransferred toner (waste toner) remaining on the surface of the photosensitive drum 1 after the primary transfer, and a support member 6*b* to support the elastic member, are integrated to the cleaning blade 6. The waste toner removed from the surface of the photosensitive drum 1 by the cleaning blade 6 drops into the space formed by the cleaning blade 6 and the cleaning frame 14 in the gravity direction, and is stored in the waste toner storing portion 14*a*.

Seal Configuration of Developing Chamber

Figure 4A:
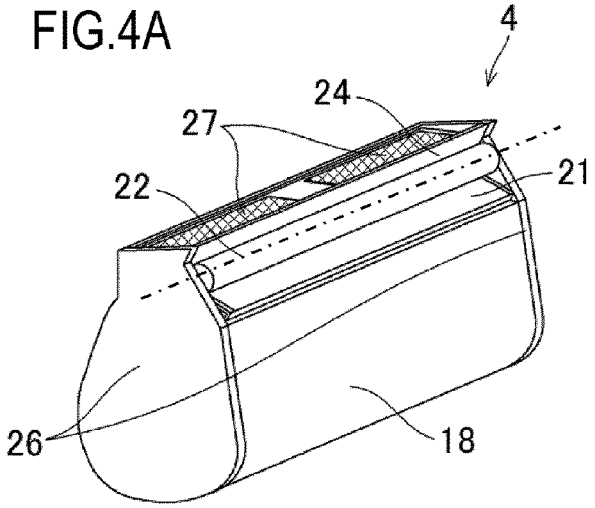
FIGS. 4A to 4D show perspective views and a cross-sectional view of a developing unit according to this invention.
Figure 4B:
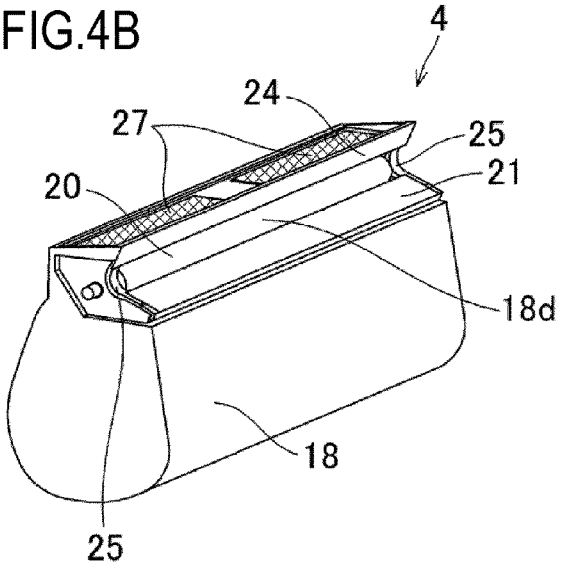
Figure 4C:
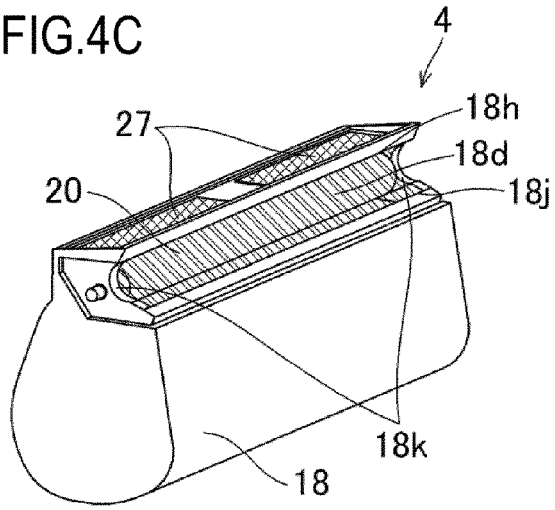
Figure 4D:
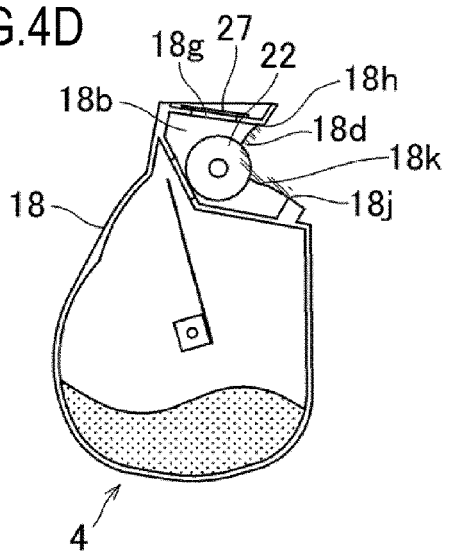

The configuration of the developing chamber 18*b* will be described with reference to FIG. 1 and FIGS. 4A to 4D. FIG. 4A is a schematic perspective view of the developing unit 4 of this example. FIG. 4B is a perspective view of the developing unit 4 in the state when the bearing unit 26 and the developing roller 22 are removed from the state in FIG. 4A. FIG. 4C is a perspective view of the developing unit 4 in the state when an elastic sheet 24, a developing blade 21 and an end seal member 25 are removed from the state in FIG. 4B. FIG. 4D is a schematic cross-sectional view of the developing unit 4 in the state in FIG. 4B.

As illustrated in FIGS. 4C and 4D, the developing chamber 18*b* includes: an upper edge portion 18*h*, a lower edge portion 18*j*, and both side portions 18*k*. In the developing opening 18*d*, the developing roller 22, which carries toner, is rotatably installed via the bearing unit 26, such that a part of the developing roller 22 is exposed outside the developing frame 18 via the developing opening 18*d*. As illustrated in FIGS. 4A and 4B, the developing blade 21, which extends toward the surface of the developing roller 22 so as to control the toner layer thickness on the developing roller 22, is installed on the lower edge portion 18*j* side of the developing opening 18*d*. On the other hand, the elastic sheet 24 (corresponding to the sealing sheet) is installed on the upper edge portion 18*h* side of the developing opening 18*d*. In other words, the upper edge portion 18*h* is a fixed portion to which the elastic sheet 24 is fixed. The base portion of the elastic sheet 24 is installed in the developing frame 18, and the tip portion of the elastic sheet 24 contacts the developing roller 22, so as to prevent developer leakage from the developing unit 4.

Here, as illustrated in FIG. 4C, the length of the developing opening 18*d* in the direction of the rotation axis line of the developing roller 22 is longer than the length of the developing opening 18*d* in the direction orthogonal to the direction of the rotation axis line of the developing roller 22. In other words, the longitudinal direction of the developing opening 18*d* is the same as the direction of the rotation axis line of the developing roller 22. The transverse direction of the developing opening 18*d* is the same as the direction orthogonal to the direction of the rotation axis line of the developing roller 22. The upper edge portion 18*h* and the lower edge portion 18*j* are edge portions extending along the longitudinal direction of the developing opening 18*d*. Both side edge portions 18*k* correspond to the end portions of the developing openings 18*d* in the longitudinal direction. And both side edge portions 18*k* are edge portions extending along the transverse direction of the developing opening 18*d*.

The end seal member 25 is disposed on both side edge portions 18*k* of the developing opening 18*d* respectively, so as to seal each gap with the developing frame 18, the developing roller 22, the developing blade 21, and the elastic sheet 24. The end seal member 25 is a flexible member that press-contacts the peripheral surface of the developing roller 22, the rear surface of the developing blade 21, and the rear surface of the elastic sheet 24 when the end seal member 25 is installed in the developing unit 4. Thereby the developing unit 4 is sealed in the axis direction of the developing roller 22. In other words, as illustrated in FIGS. 4A to 4D, in the longitudinal direction of the developing opening 18*d*, the elastic sheet 24 contacts the developing roller 22 in the area between the inner end portion of the end seal member 25 disposed on one end and the inner end portion of the end seal member 25 disposed on the other end. The elastic sheet 24 and the end seal member 25 both have a function of a sealing member which prevents developer leakage through an area between the developing frame 18 and the developing roller 22.

Configuration to Convey Toner

The configuration to convey toner inside the toner storing chamber 18*a* to the developing chamber 18*b* will be described with reference to FIG. 1 and FIGS. 5A to 5E. FIGS. 5A to 5E are schematic cross-sectional views of the process cartridge 7.

The stirring sheet 23*b*, which is a convey unit, contacts the inner wall surface of the toner storing chamber 18*a*, and the stirring member 23, which is a developer conveying member, rotates at 100 rpm in the state where the stirring sheet 23*b* is bent. The toner storing chamber 18*a* has a release position 18*e* where the stirring sheet 23*b* is released from the bent state. When the stirring sheet 23*b* passes through the release position 18*e*, the stirring sheet 23*b* flips up the toner laying on the stirring sheet 23*b* by the force generated when the stirring sheet 23*b* is released from the bent state, and conveys the toner to the toner supply roller 20 inside the developing chamber 18*b* through the toner supply opening 18*c*. In other words, the stirring sheet 23*b* is deformable, and conveys toner by release of this deformation.

As illustrated in FIG. 1, the tip portion of the stirring sheet 23*b*, the rotation shaft 23*a*, and the toner supply opening 18*c* are disposed to satisfy the following relationship in the direction orthogonal to the rotation axis line of the stirring sheet 23*b*. The length of the stirring sheet 23*b* is set such that even the toner on the bottom 18*f* of the toner storing chamber 18*a* can be stirred and conveyed. In other words, as illustrated in FIG. 1, the length W0 from the center of the rotation shaft 23*a* to the tip portion of the stirring sheet 23*b*, with respect to the length W1 from the center of the rotation shaft 23*a* to the bottom 18*f* of the toner storing chamber 18*a*, satisfies W0>W1. Furthermore, in order to stably convey the toner to the developing chamber 18*b*, the length W0 is set such that the relationship, with respect to the length W2 from the center of the rotation shaft 23*a* to the lower end of the toner supply opening 18*c*, satisfies W0>W2. In other words, as illustrated in FIG. 1, the distance between the tip of the stirring sheet 23*b* in the undeformed state and the rotation axis line of the stirring sheet 23*b* is longer than the shortest distance between the opening 18*c* and the rotation axis line of the stirring sheet 23*b*. The state of the stirring sheet 23*b* and toner, while the stirring member 23 makes a complete cycle, will be described with reference to FIGS. 5A to 5E.

Figure 5A:
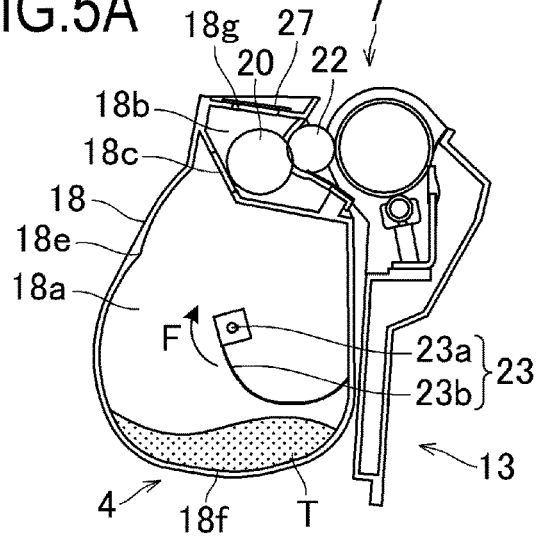
FIGS. 5A to 5E show cross-sectional views of the process cartridge according to this invention.
Figure 5B:
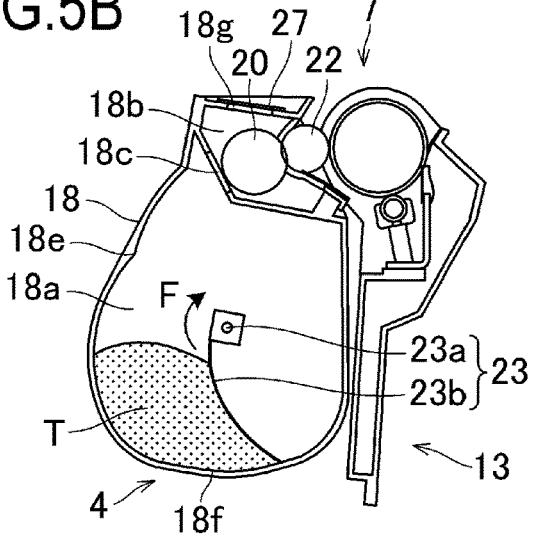
Figure 5C:
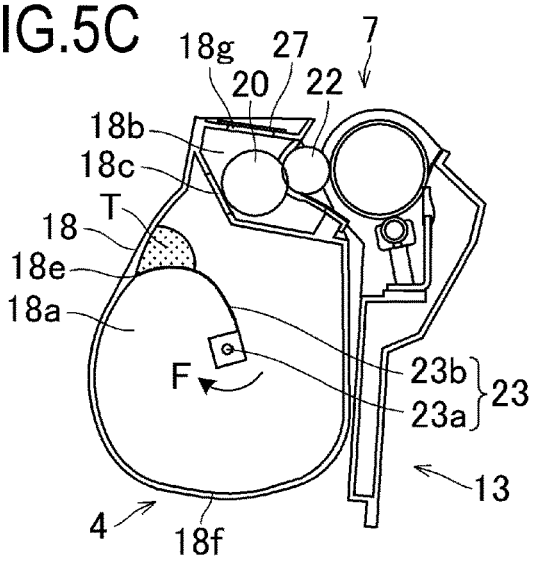
Figure 5D:
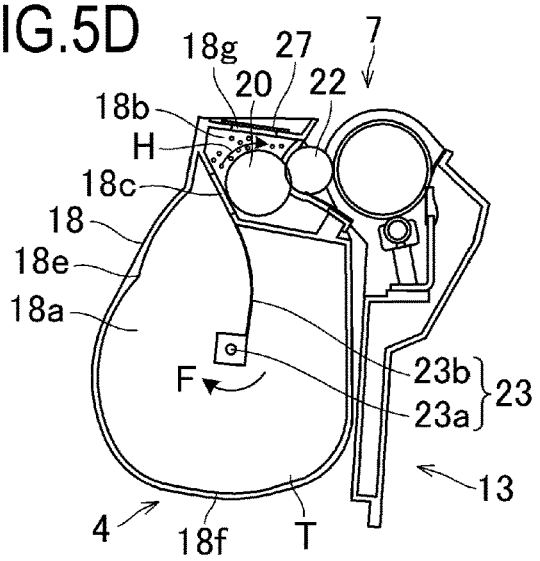

FIG. 5A depicts the state of toner when the stirring sheet 23*b* is in the phase of starting to push the upper surface (interface) of the deposited toner. Then the stirring sheet 23*b* rotates in the arrow F direction in FIGS. 5A to 5E. The stirring sheet 23*b*, which reached the phase in FIG. 5B, lifts up and conveys the toner. Then the stirring sheet 23*b* rotates in the arrow F direction, and the stirring sheet 23*b* reaches the phase of the release position 18*e*, as illustrated in FIG. 5C. The toner in-convey is on the stirring sheet 23*b*, and immediately after the stirring sheet 23*b* passes the release position 18*e*, the stirring sheet 23*b* is released from the bent state, and the toner is flipped up toward the toner supply opening 18*c*. Then, as illustrated in FIG. 5D, the stirring sheet 23*b* conveys the toner to the toner supply opening 18*c* using the force that returns from the bent state to the released state, and collides with the toner supply opening 18*c* so as to push the toner into the developing chamber 18*b*. Then the stirring sheet 23*b* rotates in the arrow F direction, and enters the phase of the stirring sheet 23*b* in FIG. 5A again. The stirring sheet 23*b* rotates continuously in the arrow F direction, and toner on the stirring sheet 23*b* is flipped up every time the stirring sheet 23*b* passes the phase of the release position 18*e*, whereby toner is successively conveyed to the developing chamber 18*b* through the toner supply opening 18*c*. In other words, the developing opening 18*d* is an opening which connects the toner storing chamber 18*a* and the developing chamber 18*b*, so that the toner in-convey can pass from the toner storing chamber 18*a* to the developing chamber 18*b*.

Figure 5E:
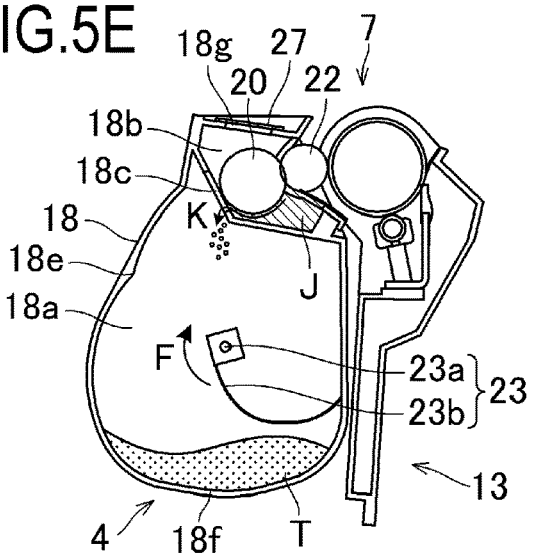

At this time, as illustrated in FIG. 5D, the toner conveyed from the toner storing chamber 18*a* passes through the toner supply opening 18*c*, passes above the toner supply roller 20, and is conveyed toward the developing opening 18*d* (arrow H direction in FIG. 5D). Further, the toner conveyed to the developing opening 18*d* is conveyed to the contact portion between the supply roller 20 and the developing roller 22, and a part of the toner is supplied to the developing roller 22. The toner, not supplied to the developing roller 22, is conveyed to a region J, which is surrounded by the developing blade 21, the developing roller 22, the toner supply roller 20, and the lower end of the toner supply opening 18*c* in the developing chamber 18*b*, by the rotation of the developing roller 22 and the toner supply roller 20. When a sufficient amount of toner is supplied to the developing chamber 18*b*, as illustrated in FIG. 5E, the region J is filled with toner, and excessive toner returns to the toner storing chamber 18*a* through the toner supply opening 18*c* (arrow K direction in FIG. 5E) by the rotation of the toner supply roller 20.

The length W0 from the rotation shaft 23*a* to the tip of the stirring sheet 23*b*, with respect to the length W2 from the rotation shaft 23*a* to the lower end of the toner supply opening 18*c* is set to be W0>W2, this means that at this time, the string sheet collides with the portion where the toner supply opening 18*c* is formed in the portion wall 18*m*.

Configuration of Ventilation Opening and Filter Member

Figure 6A:
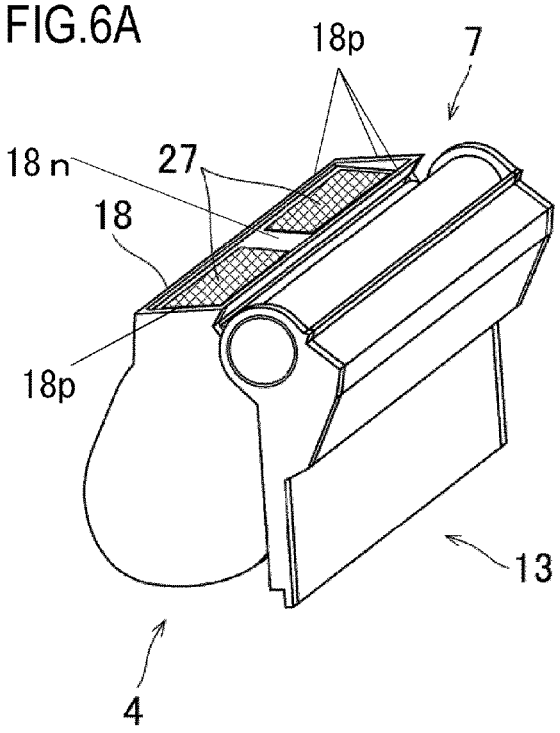
FIGS. 6A and 6B show perspective views of the process cartridge according to this invention.

In this example, toner leakage, caused by an increase in the pressure inside the developing chamber 18*b*, is effectively suppressed by disposing the ventilation opening (second opening) 18*g* and the filter member (hereafter called "filter") 27. As mentioned above, in the configuration of this example, the stirring member 23 rotates at 100 rpm (rotates 100 times per minute). This is because a high-speed processing speed is demanded (conventionally about 75 rpm). In the case of the configuration in which the stirring speed is faster than prior art, as in this example, the pressure inside the frame 18 can be easily increased by the rotation of the stirring member 23, and if the internal pressure is high, toner more easily scatters and toner leakage, as mentioned above, is a concern. Therefore the increase in pressure must be suppressed by disposing the ventilation opening 18*g* and the filter 27. It is known that such a mechanism to suppress the increase in pressure is required when the rotation speed of the stirring member 23 is 80 rpm or faster. The ventilation opening 18*g* and the filter 27 will be described with reference to FIG. 1 and FIGS. 6A and 6B. FIG. 6A is a perspective view of the process cartridge 7, and FIG. 6B is a perspective view of the process cartridge 7 in the state when the filter 27 is removed.

Figure 6B:
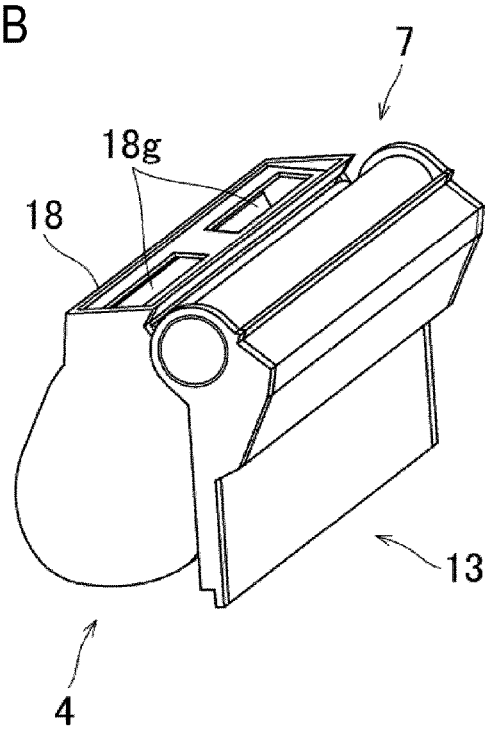

As illustrated in FIG. 1 and FIGS. 6A and 6B, the ventilation opening 18*g* is a surface constituting the developing chamber 18*b*, and is extending in the longitudinal direction of the developing unit 4, so as to connect to outside the developing unit 4. As illustrated in FIG. 1, the ventilation opening 18*g* connects inside the developing chamber 18*b* with outside the developing frame 18 in the cross-sectional direction, which is orthogonal to the rotation axis line of the stirring sheet 23*b* (orthogonal direction with respect to the direction of the rotation axis line of the stirring sheet 23*b*). Further, the ventilation opening 18*g* is disposed in a wide rectangular region which is long in the longitudinal direction of the developing unit 4, so as to extend from one end to the other end of the developing roller 22. In other words, the length of the ventilation opening 18*g* in the rotation axis line direction of the stirring sheet 23*b* is longer than the length of the ventilation opening 18*g* in the direction orthogonal to the rotation axis line direction of the stirring sheet 23*b* (transverse direction of the developing unit 4). For example, as illustrated in FIG. 1 and FIG. 4D, the ventilation opening 18*g* and the opening 18*c* are configured to intersect with a single cross-section of the stirring member 23 in the orthogonal direction with respect to the rotation axis line of the stirring member 23. For example, as illustrated in FIG. 1, the ventilation opening 18*g* and the opening 18*c* face each other so that a rectangular virtual region can be formed by the ventilation opening 18*g*, the opening 18*c*, and two virtual lines (L1, L2) connecting the ends of the ventilation opening 18*g* and the opening 18*c* when viewing the cross-section orthogonal to the rotation axis line of the stirring member 23. In other words, when the ventilation opening 18*g* and the opening 18*c* are viewed from the direction orthogonal to a virtual surface region including the opening edge of the ventilation opening 18*g*, or the direction orthogonal to a virtual surface region including the opening edge of the opening 18*c*, at least a part of the ventilation opening 18*g* overlaps with at least a part of the opening 18*c*. This means that the range of the ventilation opening 18*g* and the range of the opening 18*c* at least partially overlap with each other in the axis line direction of the rotation shaft 23*a* (longitudinal direction). As mentioned above, in the orthogonal direction with respect to the direction of the rotation axis line of the stirring sheet 23*b*, the ventilation opening 18*g* connects inside the developing chamber 18*b* and outside the developing frame 18 (FIG. 1). By disposing the ventilation opening 18*g* in this direction, the change in the pressure inside the developing chamber 18*b*, caused by the stirring sheet 23*b*, can be effectively reduced.

It is sufficient that the ventilation opening 18*g* is disposed in at least one location, and as the area of the ventilation opening 18*g* becomes larger, the effect of releasing pressure improves. In this example, the ventilation opening 18*g* is disposed in two locations, in order to obtain a sufficient rigidity in the frame and a high ventilation effect.

As illustrated in FIGS. 4A to 4D and FIG. 6A, the ventilation opening 18*g* is disposed on two locations in this example. In this case, the ventilation opening 18*g* is not disposed at the center of the developing opening 18*d* in the longitudinal direction of the developing opening 18*d*. In other words, in the longitudinal direction, each ventilation opening 18*g* is disposed in a position that is shifted from the center position of the developing opening 18*d* respectively. As a result, in the longitudinal direction of the developing opening 18*d*, the center position of the developing opening 18*d* overlaps with the position of the connection wall 18*n* of the ventilation opening 18*g*.

By disposing the ventilation opening 18*g* on the connection wall 18*n*, which is the wall surface closest to the developing opening 18*d*, pressure can be effectively decreased in an area near the developing opening 18*d*. Further, the rigidity of the developing frame 18 (especially the connection wall 18*n*) can be improved at the center area in the longitudinal direction.

Furthermore, as illustrated in FIGS. 4A to 4D, FIGS. 5A to 5E, and FIGS. 6A and 6B a convex portion 18*p* is disposed around the ventilation opening 18*g*. Thereby the rigidity of the developing frame 18 can be improved in an area around the ventilation opening 18*g*. In this example, the convex portion 18*p* extends along the longitudinal direction and in the transverse direction of the ventilation opening 18*g*, respectively. Each convex portion 18*p* is disposed for both ventilation openings 18*g*. The convex portion 18*p* may have a portion which extends in the transverse direction at the center of the longer side of the opening 18*c*, so as to cross the ventilation opening 18*g*.

Moreover, as illustrated in FIG. 1, it is assumed that the line connecting one end of the ventilation opening 18*g* and one end of the opening 18*c* in the direction orthogonal to the rotation shaft 23*c* is the first line L1. Further, it is assumed that the line connecting the other end of the ventilation opening 18*g* and the other end of the opening 18*c* is the second line L2. In this case, the region between the first line L1 and the second line L2 is a region which includes the shortest path out of the paths for the air that passed through the opening 18*c* to reach the ventilation opening 18*g*. In the configuration illustrated in FIG. 1, at least a part of the supply roller 20 is located outside the region between the first line L1 and the second line L2. Thereby it can be prevented that the region between the first line L1 and the second line L2 is decreased by the supply roller 20. In the case of disposing a plurality of ventilation openings 18*g*, it is not necessary to dispose all the ventilation openings 18*g*, as mentioned above. In other words, only a part of the ventilation openings 18*g* and the supply roller 20 may satisfy the above mentioned positional relationship.

As illustrated in FIG. 1, the connection wall 18*n* is connected to the fixed portion (upper edge portion 18*h*). The connection wall 18*n* extends in the orthogonal direction (direction orthogonal to the direction of the rotation axis line of the developing roller 22, or the rotation axis line of the stirring sheet 23*b*), so as to cross the extending direction of the elastic sheet 24. The connection wall 18*n* can be regarded as a wall surface which supports the fixed portion (upper edge portion 18*h*) in the thickness direction of the elastic sheet 24. In this example, the ventilation opening 18*g* is disposed on the upper surface (connection wall 18*n*) of the developing frame 18. In this case, the region J inside the developing chamber 18*b* is always filled with toner, and the ventilation opening 18*g* should be disposed on a surface which does not constitute the region J.

Further, the wall surface on which the ventilation opening 18*g* is disposed is a wall surface of which one side forms the inner wall of the developing chamber 18*b*, and the other side forms a part of the outer wall of the developing frame 18. As illustrated in FIG. 1, the size of the ventilation opening 18*g* can be increased by disposing the ventilation opening 18*g* on the largest wall surface among such wall surfaces.

The ventilation opening 18*g* is disposed at the upstream side of the developing opening 18*d* on the toner conveying path (arrow mark H in FIG. 5D). Therefore the air conveyed from the toner storing chamber 18*a* is discharged from the ventilation opening 18*g* before reaching the developing opening 18*d*, where toner leakage more easily occurs. Thereby the pressure inside the developing chamber 18*b* can be effectively decreased, and toner leakage can be suppressed. Furthermore, the ventilation opening 18*g* is disposed in the developing chamber 18*b* in an area close to both the ends. Thereby the increase in pressure toward the end seal member 25 disposed in the end portion of the developing opening 18*d* can be effectively suppressed, and toner leakage can be controlled.

As illustrated in FIG. 6B, the filter 27 is disposed to cover the ventilation opening 18*g*, and is constituted by a material which prevents toner leakage inside the developing unit 4 (passing of toner through the ventilation openings 18*g*), and allows air, inside the developing unit 4, to pass through. In other words, the filter 27 allows air to pass through the ventilation opening 18*g*, and stops toner from passing through. As depicted in FIGS. 6A and 6B, the filter 27 is larger than the ventilation opening 18*g* when viewed in the normal line direction of the surface on which the filter 27 is fixed. It is preferable that the material of the filter 27 has high air permeability. The higher the air permeability, the more the ventilation effect improves, and a higher inner pressure reduction effect can be achieved. This means that a greater effect in preventing toner leakage can be obtained.

In this example, the filter 27 is welded to the developing frame 18 from outside the wall surface of the developing frame 18. The method for fixing the filter 27 to the developing frame 18 is not limited to welding, but may be double-sided tape, adhesive or the like. The filter 27 may be fixed from inside the developing unit 4. The filter 27 may also be integrated with the developing frame 18, such as insert-molded in the developing unit. The filter 27 can be fixed in any way as long as air can pass, and toner leakage through the ventilation opening 18*g* can be prevented.

Figure 8A:
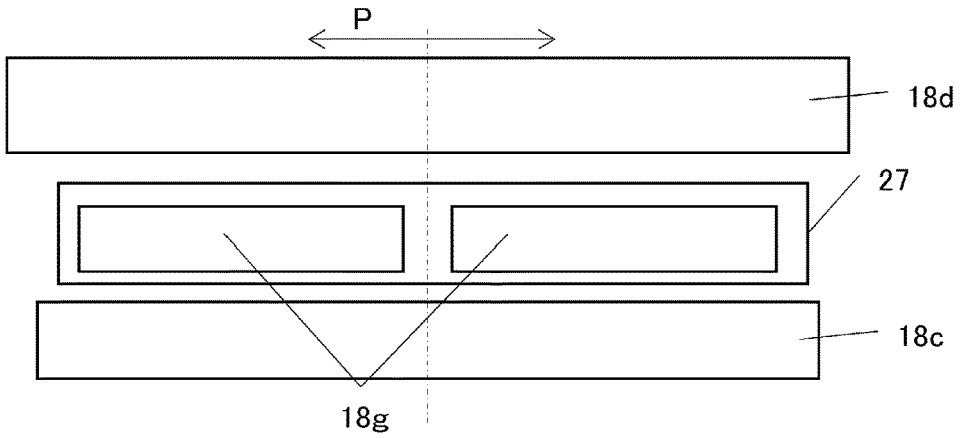
FIGS. 8A to 8C show diagrams depicting examples of the arrangement of ventilation openings and filters according to this invention.
Figure 8B:
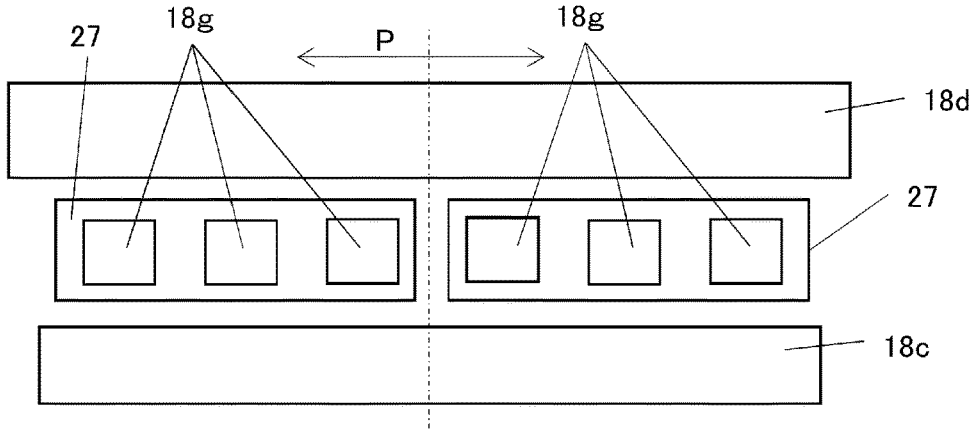
Figure 8C:
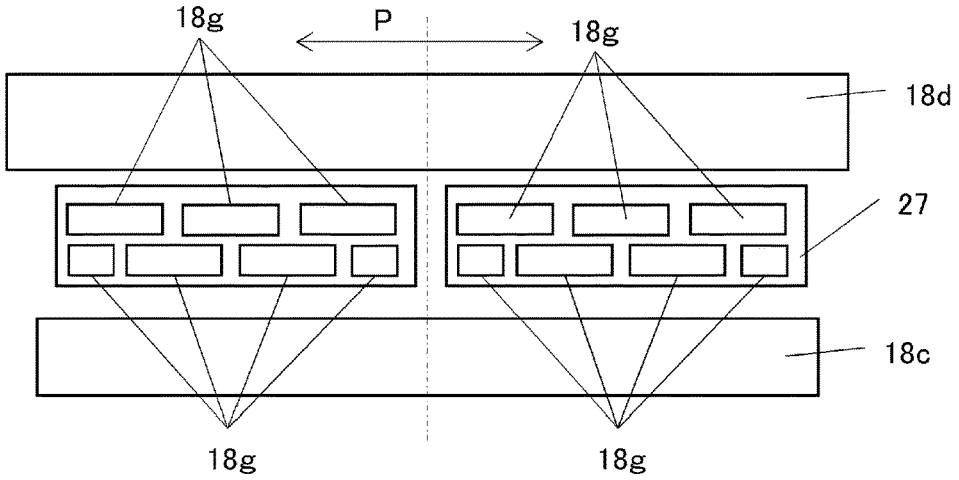

The number of filters 27 is one or more, and is not limited to a specific number. In this example, two filters 27 cover the two ventilation openings 18*g*. Here the number of ventilation openings 18*g* and the number of filters 27 need not be the same, and, for example, one filter 27 may cover a plurality of ventilation openings 18*g*. In other words, the ventilation openings 18*g* and the filter 27 may be disposed as illustrated in FIGS. 8A to 8C. FIGS. 8A to 8C show examples of the positions of the ventilation openings 18*g* and the filters 27 according to this example. FIGS. 8A to 8C show schematic diagrams when the ventilation openings 18*g*, the filters 27, the opening 18*c* and the developing opening 18*d* are viewed in the direction orthogonal to the rotation axis line direction of the stirring sheet 23*b*. The arrow P indicates the rotation axis line direction of the stirring sheet 23*b*. In FIGS. 8A to 8C, portions other than the ventilation openings 18*g*, the filters 27, the opening 18*c* and the developing opening 18*d* are omitted.

As illustrated in FIG. 8A, one region and the other region of the developing opening 18*d*, separated at the center of the developing opening 18*d* in the longitudinal direction, may have a single ventilation opening 18*g* respectively (each ventilation opening 18*g* covers approximately the entire area of each region respectively). The shape of the ventilation opening 18*g* is not limited to a rectangle as illustrated, but may be various different shapes, such as a rectangle with rounded corners, and an ellipse.

As illustrated in FIG. 8B, a plurality of ventilation openings 18*g* may be disposed side by side in the longitudinal direction in the above mentioned one region and the other region respectively (each ventilation opening 18*g* in FIG. 8A is divided in the longitudinal direction). The number of ventilation openings 18*g* disposed in each region is not limited to the number illustrated in FIG. 8B, but may be two, or more than three respectively. The shape and size of each ventilation opening 18*g* may be the same shape and size as illustrated in FIG. 8B, or may be different from each other. Here in each ventilation opening 18*g*, the length in the longitudinal direction (rotation axis line direction of the stirring sheet 23*b*) may be longer or shorter than the length in the transverse direction (transverse direction of the developing unit 4), which is orthogonal to the longitudinal direction. In other words, all that is required is that the total length, adding the length of each ventilation opening 18*g* in each region in the longitudinal direction, is longer than the length of each ventilation opening 18*g* in the transverse direction.

Further, as illustrated in FIG. 8C, a plurality of ventilation openings 18*g* may be disposed side by side in the transverse direction for each region of the developing opening 18*d*. The number of ventilation openings 18*g* disposed in the transverse direction is not limited to the number illustrated in FIG. 8C, but may be three or more. The number of ventilation openings 18*g* of each row disposed in the transverse direction, the shapes and sizes thereof, and the arrangement thereof are not limited to the configuration illustrated in FIG. 8C, where the number of ventilation openings 18*g* is different between rows, and the shapes and sizes of the ventilation openings 18*g* are different from one another, and the ventilation openings 18*g* in the top and bottom rows are disposed alternately. In other words, the ventilation openings 18*g* may be disposed in a lattice, where the same number, the same shape and the same size of the ventilation openings 18*g* are disposed and aligned in each row.

In this example, the material of the filter is a non-woven fabric, of which the average pore diameter is 5 μm, in order to obtain both collectability and permeability.

Image Forming Process

When an image is formed, the photosensitive drum 1 (ϕ30 perfect circle) is initially rotating at 300 rpm in the arrow A direction. Then the surface of the photosensitive drum 1 is uniformly charged by the charging roller 2. The charging roller 2 is a ϕ20 conductive rubber roller, and is driven and rotated by pressing the roller portion against the photosensitive drum 1, and a predetermined DC voltage is applied to the core metal of the charging roller 2 in the charging step for the photosensitive drum 1. Thereby a uniform dark electric potential (Vd) is formed.

The spot pattern of the laser light from the scanner unit 3, which is emitted corresponding to the image data, exposes the photosensitive drum 1, and in the exposed part, charges on the surface dissipate by the carriers from the carrier generation unit, and potential drops. As a result, an electrostatic latent image of a predetermined light electric potential (V1) is formed in the exposed portion of the photosensitive drum 1, and an electrostatic latent image of a predetermined dark electric potential (Vd) is formed in the unexposed portion on the photosensitive drum 1. In this example, it is assumed that Vd=−500 V and V1=−100 V.

The electrostatic latent image formed on the photosensitive drum 1 contact with toner which the developing unit 4 conveyed to the developing roller 22, is developed, and becomes a toner image. Here Vdc=−300 V is applied to the developing roller 22, so as to generate ΔV=200 V of potential difference from the light electric potential, and the toner image is formed as the developing roller 22 rotates in the driven direction with respect to the photosensitive drum at a peripheral speed difference of 150%.

Toner that is used in this example has a degree of agglomeration of 5% to 40%, and an average particle diameter of 8 μm in non-used state. In order to ensure the flowability of toner for its entire lifespan, it is desirable to use toner having this degree of agglomeration. The degree of agglomeration of toner was measured as follows.

For the measuring device, a powder tester (made by Hosokawa Micro Corporation), including a digital vibration meter (Digital Vibration Meter Model 1332, manufactured by Showa Sokki Corporation) was used. As the measurement method, 390 mesh, 200 mesh and 100 mesh sieves were stacked up on a vibration table in the sequence of smaller sieve openings, that is, in the sequence of the 390 mesh, 200 mesh and 100 mesh sieves, with the 100 mesh sieve on top. Then an accurately measured 5 g sample (toner) is placed on the 100 mesh sieve that is set as mentioned above, the displacement value of the digital vibration meter was adjusted to 0.60 mm (peak-to-peak), and vibration was applied for 15 seconds. Then the mass of the sample remaining on each sieve was measured, and the degree of agglomeration was obtained based on the following expression.

The measurement sample used here was left for 24 hours in advance in a 23° C. 60% RH environment, and measurement was performed under this 23° C. 60% RH environment. Degree of agglomeration (%)=(mass of sample remaining on 100 mesh sieve/5 g)×100+(mass of sample remaining on 200 mesh sieve/5 g)×60+(mass of sample remaining on 390 mesh sieve/5 g)×20

The toner image formed on the photosensitive drum 1 is transferred onto the intermediate transfer belt 5 (primary transfer) by the function of the primary transfer roller 8. Here the primary transfer roller 8 is set to the transfer voltage Vtr=+1 kV, in order to transfer the negatively charged toner from the photosensitive drum 1 onto the intermediate transfer belt 5.

When a full color image is formed, the above mentioned processing is sequentially performed by the first to fourth image forming units SY, SM, SC and SK, and a toner image of each color is sequentially superimposed on the intermediate transfer belt 5 as the primary transfer. Then synchronizing with the movement of the intermediate transfer belt 5, the recording material 12 is conveyed to the secondary transfer unit. Then by the function of the secondary transfer roller 9, which is in contact with the intermediate transfer belt 5 via the recording material 12, the four-color toner images on the intermediate transfer belt 5 are transferred onto the recoding material 12 in batch as the secondary transfer. The recording material 12, on which the toner image was transferred, is conveyed to the fixing apparatus 10, which is a fixing unit. The toner image is fixed to the recording material 12 by the fixing apparatus 10 applying heat and pressure to the recording material 12, and the recording material 12 is discharged at about a 60 ppm speed.

The primary untransferred toner, which remained on the photosensitive drum 1 after the primary transfer step, is removed by the cleaning blade 6. The secondary untransferred toner, which remained on the intermediate transfer belt 5 after the secondary transfer step, is removed by the intermediate transfer belt cleaning apparatus 11. The removed untransferred toner (waste toner) is discharged to a waste toner box (not illustrated) of the image forming apparatus 100. The image forming apparatus 100 can also form a single color or a multi-color image using only a desired single or some (not all) image forming units.

Features of this Example

Figure 7A:
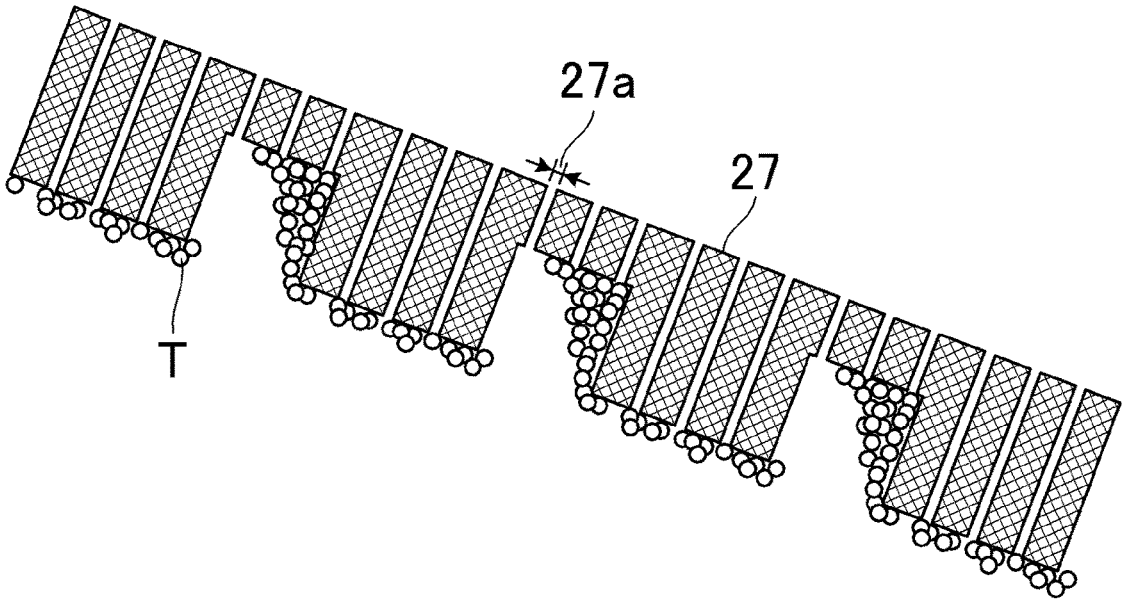
FIGS. 7A and 7B show cross-sectional views depicting the states of a filter member according to this invention.
Figure 7B:
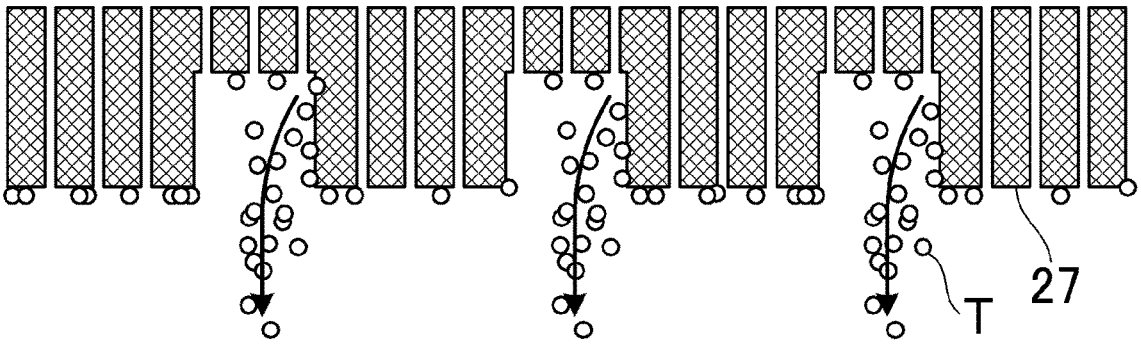

The features of this example will be described with reference to FIGS. 7A and 7B. FIG. 7A is a schematic enlarged view of the filter position when an image is formed (developing contact time), and FIG. 7B is a schematic enlarged view of the filter position when an image is not formed (developing separation time). The process cartridge 7 is configured such that the developing roller 22 and the photosensitive drum 1 can be in contact/separated, and the relative position of the developing unit 4 (first unit) and the photosensitive member unit 13 (second unit) can be changeable. The developing unit 4 (developing frame 18) rotates around the developing contact/separation support point 17, and changes the position (angle with respect to the photosensitive member unit 13) depending on whether a pressurized unit 18*i* is pressed by a pressurizing unit 80 of a developing contact/separation mechanism disposed in the image forming apparatus 100. Thereby the developing unit 4 takes a position with respect to the photosensitive member unit 13: either a contacted state where the photosensitive drum 1 and the developing roller 22 are in contact (corresponding to the contact position or the second position); or a separated state where the photosensitive drum 1 and the developing roller 22 are separated (corresponding to the separated position or the first position). This makes the developing separation of the photosensitive drum 1 and the developing roller 22 possible. In this way, the developing unit 4 can move between the contact position and the separation position (the contact position can be displaced with respect to the apparatus main body). The second position of the developing frame 18 may be a position where the developing roller 22 and the photosensitive drum 1 are in proximity separated by a gap. In other words, the developing unit 4 of this example is configured such that the distance between the developing roller 22 and the photosensitive drum 1 at the first position of the developing frame 18 is longer than the distance between the developing roller 22 and the photosensitive drum 1 at the second position of the developing frame 18.

When the pressurized unit 18*i* is pressurized (pressed) by the pressurizing unit 80, the position of the developing unit 4, with respect to the photosensitive member unit 13, changes (rotates) with the developing contact/separation support point 17 at the predetermined rotation shaft as the support point, and the developing roller 22 separates from the photosensitive drum 1. In other words, in this example, the developing frame 18 rotates around the support point 17. In this example, the developing separation amount is 10 mm, and the upper surface (corresponding to the filter installation surface) on which the filter 27 is disposed, becomes horizontal in the separation state. This means that the exposed surface of the filter 27 (surface of the filter 27 on the developing storing unit side), which is exposed to the inside of the developing frame 18 (developer storing portion), is also horizontal or at an angle close to horizontal. In other words, in the state where the developing roller 22 is separated from the photosensitive drum 1, the angle between the horizontal surface and the exposed surface (angle on the narrow angle side) is 0° or close to 0°.

When the applied pressure by the developing contact/separation mechanism to the pressurized unit 18*i* is reduced or becomes zero, the developing unit 4 rotates around the developing contact/separation support point 17, and is displaced with respect to the photosensitive member unit 13 by the elastic force (biasing force) of a developing contact spring 181 which is an biasing member. Thereby the developing roller 22 and the photosensitive drum 1 contact. In other words, in the developing frame 18 of the developing unit 4, the biasing force, to change the position of the developing frame 18 with respect to the cleaning frame 14 from the separation position to the contact position, is always applied. In this case, the upper surface becomes 30° with respect to the horizontal direction. This means that the surface of the filter 27, exposed to the inside of the developing frame 18, also has a 30° or closer angle. In other words, in the state where the developing roller 22 is in contact with the photosensitive drum 1, the angle between the horizontal surface and the exposed surface (angle on the narrow angle side) is 30° or close to 30°.

As mentioned above, in the filter 27, the angle between the horizontal surface and the exposed surface changes between the contact state and the separation state. In this example, the angle between the horizontal surface and the exposed surface in the separation state is smaller than the angle between the horizontal surface and the exposed surface in the contact state.

In this way, by changing the position of the developing unit 4 using the developing contact/separation mechanism, the position of the filter 27 can also be changed as illustrated in FIGS. 7A and 7B. In concrete terms, in the developing contact state illustrated in FIG. 7A, toner is gradually collected in the concave portions on the surface of the filter 27 by the supply of toner from the stirring member 23, and by the scattering of toner due to the rotation of the toner supply roller 20 and the developing roller 22. In other words, toner adheres to the exposed surface of the filter 27, which is exposed to the inside the developing frame 18. In this case, countless filter holes 27*a*, which are open in the filter 27, clog, and the ventilation capability drops considerably. In particular, if the stirring member 23 rotates in the arrow F direction in the developing contact state, air is supplied toward the toner supply opening 18*c* of the developing chamber 18*b*, where the ventilation opening 18*g* and the filter 27 are disposed on the wall surface, by the movement of the stirring sheet 23*b*. Because of this configuration, toner is easily collected in the concave portions on the surface of the filter 27. In the developing separation state illustrated in FIG. 7B, on the other hand, the toner collected in the concave portions easily fall in the vertical direction due to gravity. As a result, the toner around the filter holes 27*a* is eliminated, and ventilation can be sufficiently performed. Thereby a drop in ventilation capability can be suppressed, and a pressure increase in the developing chamber 18*b* can be suppressed, and as a result, toner leakage can be controlled.

The filter 27 is located in a position more distant from the rotation support point 17 of the developing unit 4, compared with the developing roller 22 and the toner supply roller 20, and is disposed so that the displacement amount in the contact/separation operation is more than that of the developing roller 22 and the like. In other words, the filter 27 is disposed such that the distance between the filter 27 and the rotation support point 17 (center of the rotary displacement) (the shortest distance, such as the distance between the right end of the filter 27 and the rotation support point 17 in the portion overlapping with the opening 18*g* in the cross-section in FIG. 1) is longer than the distance between the developing roller 22 and the rotation support point 17 (the longest distance, such as a distance between the point most distant from the rotation support point 17 on the peripheral surface of the developing roller 22 and the rotation support point 17 in the cross-section in FIG. 1). Thereby vibration is more easily generated on the filter 27 by the contact/separation operation, and the adhering toner can be more effectively separated.

Concerning the timing of the developing contact/separation in this example, the developing contact operation is performed during prior rotation, before forming the image, and the developing separation operation is performed during the post-rotation, after forming the image. In other words, the developing unit 4 is in the developing contact state while the image forming operation is performed. And the developing unit 4 is in the developing separation state while the image forming operation is not performed. This means that the filter installation surface and the developer contact surface of the filter 27 maintain the horizontal state, or at an angle close to the horizontal state while the image forming operation is not performed. When the developing contact state is maintained, and the post-rotation operation is not started for a long time, such as in the case of continuous printing, printing is force ended every 500 prints, and the post-rotation is performed. Then, print operation is resumed again. In this example, continuous printing is interrupted every 500 prints, and the post-rotation operation is executed to perform the developing contact/separation operation, but the present invention is not limited to this. It is desirable to set the number of prints at which printing is interrupted in accordance with the configuration of the developing apparatus. Further, in this example, continuous printing is forcibly interrupted at every predetermined number of prints, and the post-rotation operation is performed so as to perform the developing contact/separation operation, but the present invention is not limited to this. For example, if the drive instruction to the developing apparatus is interrupted and the developing contact/separation operation is repeated in a state of stopping the supply of toner, a better effect to separate toner is obtained.

Experiments

The following experiments were performed to confirm the effect of suppressing toner leakage according to this example.

1. Developing Separation Amount and Optimum Value of Angle of Filter

Verification Content

The position of the developing unit and the position of the filter member (angle with respect to vertical direction) to suppress toner leakage was verified while changing the developing separation amount by using this example and Comparative Examples 1 to 3. In concrete terms, the developing separation amount is zero in Comparative Example 1, and is increased respectively by 5 mm in the sequence of Comparative Example 2, Comparative Example 3 and this example. Except for this difference, the configuration of the process cartridge and the general configuration of the image forming apparatus according to Comparative Example 1, Comparative Example 2 and Comparative Example 3 are the same as this example.

Further, in order to evaluate whether toner leakage can be prevented, a continuous printing durability test was performed for 60K prints under a high temperature and high humidity environment (temperature: 30° C.; humidity: 80%), in which the degree of agglomeration of toner is low and the filter easily clogs. For this continuous printing durability test, a horizontal line, of which ratio to the image is 1%, is printed as a recording image, and 400 g of toner is filled. At every 10K prints the presence of leaked toner collected on the developer control member was visually checked.

Verification Result 1

Table 1 shows the verification result.

TABLE 1

| | Presence of toner leakage | | | |
|---|---|---|---|---|
| | Comparative Example 1 | Comparative Example 2 | Comparative Example 3 | This example |
| Developing contact/separation | NO | YES | YES | YES |
| Developing separation amount | 0 mm | 5 mm | 10 mm | 15 mm |
| Filter angle | 30° | 20° | 10° | 0° |
| 0K prints | ○ | ○ | ○ | ○ |
| 10K prints | ○ | ○ | ○ | ○ |
| 20K prints | ○ | ○ | ○ | ○ |
| 30K prints | Δ | ○ | ○ | ○ |
| 40K prints | X | Δ | ○ | ○ |
| 50K prints | — | X | Δ | ○ |
| 60K prints | — | — | X | ○ |

Comparative Example 1 will be described first. In the case of Comparative Example 1, the photosensitive drum 1 and the developing roller 22 are constantly in contact, and a small amount of toner leakage was observed at 30K prints, and extreme toner leakage was generated at 40K prints. In this state, toner clogged and ventilation performance dropped considerably.

Comparative Example 2 will be described next. In Comparative Example 2, a small amount of toner leakage was observed at 40K prints, and extreme toner leakage was generated at 50K prints. Compared with Comparative Example 1, an improvement was observed by 10K prints. This may be because the developing separation amount was set to 5 mm for the developing separation, whereby the angle of the filter member became closer to horizontal by 10° compared with Comparative Example 1, and more toner, collected in the concave portions of the filter, fell, and a drop in ventilation capability was suppressed. However, the target 60K prints was not implemented. Further, Comparative Example 3 will be described next. In the case of Comparative Example 3, a small amount of toner leakage was observed at 50K prints, and extreme toner leakage was generated at 60K prints. This is probably because, just like Comparative Example 2, the filter member became more flat due to the increase in the developing separation amount, thereby more toner, collected in the concave portions of the filter, fell, and a drop in ventilation capability was suppressed. However in this configuration as well, the target 60K prints was not implemented.

This example will now be described. In this example toner leakage was not generated until 60K prints. This is probably because the filter member became flat, thereby more toner, collected in the concave portions of the filter, fell, and a drop in the ventilation capability was suppressed.

2. Timing of Developing Separation

Verification Content

Next the timing to perform the developing separation was confirmed with respect to the number of prints, so that toner leakage is not generated. In Comparative Example 4, the developing separation is forcibly performed at every 750 prints, and in Comparative Example 5, the developing separation is forcibly performed at every 1000 prints. Except for this difference, the configuration of the process cartridge and the general configuration of the image forming apparatus of Comparative Example 4 and Comparative Example 5 are the same as this example.

Verification Result 2

Table 2 shows the presence of toner leakage in this example and in the comparative examples.

TABLE 2

| | Presence of toner leakage | | |
|---|---|---|---|
| | Comparative Example 4 | Comparative Example 5 | This example |
| Developing contact timing | 1000 | 750 | 500 |
| 0K prints | ○ | ○ | ○ |
| 5K prints | X | ○ | ○ |
| 10K prints | — | Δ | ○ |
| 20K prints | — | X | ○ |
| 30K prints | — | — | ○ |
| 40K prints | — | — | ○ |
| 50K prints | — | — | ○ |
| 60K prints | — | — | ○ |

First Comparative Example 4 will be described. In the case of Comparative Example 4, the developing separation is executed at every 1000 prints, and extreme toner leakage was generated at 5K prints.

Next Comparative Example 5 will be described. In the case of Comparative Example 5, the developing separation is executed at every 750 prints, and a small amount of toner leakage was observed at 10K prints. Then extreme toner leakage was generated at 20K prints. Even performing the developing separation every 750 prints was insufficient to suppress toner clogging.

Now this example will be described. In the case of this example, toner leakage was not generated until 60K prints. Based on this result, the developing separation must be executed at least once every 500 prints.

According to this example, in the image forming apparatus having high speed and long life, the developing separation amount is set to 15 mm, and the developing contact/separation operation is performed every 500 prints, as described above. According to this example, the angle of the filter member (surface of the second chamber thereof) becomes closer to horizontal, and toner collected in the concave portions of the filter can easily fall by the contact/separation operation. In other words, when toner clogs in the filter member due to lengthy operation, the developing apparatus and the filter member are impacted by the developing contact/separation operation, whereby the toner is more easily separated from the filter member. Hence filter clogging can be suppressed, and a drop in ventilation performance can be prevented, as verified in Experiment 1 and Experiment 2. As a result, an increase in the internal pressure of the developing chamber can be reduced or suppressed, and toner leakage from the developing unit can be prevented.

Effect of Invention

According to the present invention, an increase in the internal pressure of the unit in which the developer is stored can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-218761, filed on Nov. 9, 2016, and No. 2017-193639, filed on Oct. 3, 2017, which are hereby incorporated by reference herein in their entirety.

What is claimed is:

1. A unit configured to be detachable from an apparatus main body of an image forming apparatus, the unit comprising:

a conveying member for conveying developer;

a frame that stores the developer, the frame including:

a first chamber that stores the conveying member, a second chamber located above the first chamber, a first opening that connects the first chamber and the second chamber, and through which the developer conveyed from the first chamber to the second chamber passes, and a second opening that connects an interior of the second chamber and an exterior of the frame in an orthogonal direction that is orthogonal to a direction of a rotation axis line of the conveying member;

a developer bearing member that is disposed in the second chamber, the developer bearing member being configured to develop a latent image formed on an image bearing member; and a filter that allows passage of air and restricts passage of the developer, the filter being fixed to the frame so as to cover the second opening, wherein the conveying member is configured to rotate at a speed of greater than or equal to 80 rpm, wherein the conveying member is deformable such that the developer is conveyed from the first chamber to the second chamber via the first opening by deformation of the conveying member being released, and the conveying member is configured to convey the developer such that the developer conveyed by the conveying member contacts the filter, and wherein the frame is displaceable relative to the apparatus main body between a first position and a second position in a state where the unit is attached to the apparatus main body such that the filter is displaced relative to the apparatus main body.

2. The unit according to claim 1, wherein a distance between the developer bearing member and the image bearing member when the frame is at the first position is longer than a distance between the developer bearing member and the image bearing when the frame is at the second position.

3. The unit according to claim 2, wherein the frame receives a biasing force from a biasing member disposed between the frame and a second frame that supports the image bearing member, so as to displace the frame from the first position, where the developer bearing member is separated from the image bearing member, to the second position, where the developer bearing member contacts the image bearing member.

4. The unit according to claim 2, wherein, when the frame is displaced such that the developer bearing member is displaced relative to the image bearing member, an amount of displacement of the filter is greater than an amount of displacement of the developer bearing member.

5. The unit according to claim 2, wherein the displacement of the frame is a rotary displacement, and wherein the filter is disposed so that a distance between the filter and a center of the rotary displacement is longer than a distance between the developer bearing member and the center of the rotary displacement.

6. The unit according to claim 5, wherein the second opening is disposed so as to extend from one end to the other end of the developer bearing member in the direction of the rotation axis line.

7. The unit according to claim 5, further comprising a supply member disposed in the second chamber, the supplying member supplying the developer to the developer bearing member by contacting with the developer bearing member.

8. The unit according to claim 7, wherein, in the orthogonal direction, the second opening includes a first end and a second end opposite to the first end, and wherein when a first line, which connects one end of the first opening and the first end of the second opening, and a second line, which connects the other end of the first opening and the second end of the second opening, are drawn in the orthogonal direction, at least a part of the supply member is located outside a region between the first line and the second line.

9. The unit according to claim 7, the developer bearing member and the supplying member rotate such that, in mutual contact sections thereof, a surface of the developer bearing member and a surface of the supplying member move in a same direction.

10. The unit according to claim 5, wherein a distance between a tip of the conveying member in an undeformed state and the rotation axis line in the orthogonal direction is longer than the shortest distance between the first opening and the rotation axis line.

11. The unit according to claim 2, wherein the frame has a third opening to expose a part of the developer bearing member to the exterior of the frame, and wherein the second opening is located at an upstream side of the third opening on a conveying path of the developer in the second chamber.

12. The unit according to claim 11, wherein the second opening is located above the first opening, the developer bearing member, and the third opening.

13. The unit according to claim 11, further comprising end seals that are disposed on both edge portions of the third opening in a longitudinal direction of the third opening, and a sealing sheet that is fixed to the frame, and contacts the developer bearing member between the end seals.

14. The unit according to claim 13, wherein the frame includes a fixed portion to which the sealing sheet is fixed, and a connection wall that is connected to the fixed portion and extends in a direction intersecting a direction in which the sealing sheet extends, and wherein the second opening is disposed in the connection wall.

15. The unit according to claim 14, wherein the second opening is not disposed at the center position of the third opening in the longitudinal direction.

16. The unit according to claim 11 further comprising:

a supply member that is disposed in the second chamber and is configured to supply the developer to the developer bearing member by contacting the developer bearing member, wherein the second opening is located at an upstream side of the third opening and at a downstream side of the first opening with respect to a rotation direction of the supply member.

17. A process cartridge configured to be detachable from the apparatus main body of the image forming apparatus, the process cartridge comprising:

the unit according to claim 1; and a second unit including an image bearing member, wherein relative positions of the first unit and the second unit can be changed so that the developer bearing member and the image bearing member can be contacted or separated.

18. The unit according to claim 1, wherein the frame includes a partition portion for partitioning the first chamber and the second chamber, and the partition portion is provided with the first opening, and wherein the conveying member is contactable to the partition portion.

19. The unit according to claim 1, wherein the frame includes a wall provided with the second opening, the frame includes a convex portion projecting in a direction crossing the wall, the convex portion being disposed so as to surround the second opening, wherein the convex portion includes a first portion and a second portion, the first portion and the second portion extend along the direction of the rotation axis, the first portion is disposed at one side of the second opening, and the second portion is disposed at an other side of the second opening, and wherein with respect to the direction crossing the wall, a length of the convex portion is longer than a length of the filter.

20. The unit according to claim 1, wherein the frame is provided with a plurality of second openings, and the filter is fixed to the frame so as to cover the plurality of second openings from an outer side of the frame.

21. The unit according to claim 1, wherein the filter includes an exposed surface exposed to the interior of the second chamber, wherein the frame is configured to be moved from the second position to the first position and be positioned at the first position after an image forming operation is performed, and wherein the filter is disposed so that an angle between the exposed surface and a horizontal line at the first position is less than an angle between the exposed surface and the horizontal line at the second position.

22. The unit according to claim 1, further comprising:

a supply member that is disposed in the second chamber and is configured to supply the developer to the developer bearing member by contacting the developer bearing member, wherein the conveying member is configured to convey the developer such that the developer passes above the supply member.

23. The unit according to claim 1 further comprising:

a supply member that is disposed in the second chamber and is configured to supply the developer to the developer bearing member by contacting the developer bearing member, wherein at least part of the second opening is located directly above the supply member.

24. An image forming apparatus comprising:

an apparatus main body;

a conveying member for conveying developer;

a frame that stores the developer, the frame including:

a first chamber that stores the conveying member, a second chamber located above the first chamber, a first opening that connects the first chamber and the second chamber, and through which the developer conveyed from the first chamber to the second chamber passes, and a second opening that connects an interior of the second chamber and an exterior of the frame in an orthogonal direction that is orthogonal to a direction of a rotation axis line of the conveying member;

a developer bearing member that is disposed in the second chamber, the developer bearing member being configured to develop a latent image formed on the image bearing member; and a filter that allows passage of air and restricts passage of the developer, the filter being fixed to the frame so as to cover the second opening, wherein the conveying member is configured to rotate at a speed of greater than or equal to 80 rpm, wherein the conveying member is deformable such that the developer is conveyed from the first chamber to the second chamber via the first opening by deformation of the conveying member being released and the conveying member is configured to convey the developer such that the developer conveyed by the conveying member contacts the filter, and wherein the frame is displaceable, relative to the apparatus main body, between a first position and a second position such that the filter is displaced relative to the apparatus main body.

25. The image forming apparatus according to claim 24, further comprising:

an image bearing member, wherein a distance between the developer bearing member and the image bearing member when the frame is at the first position is longer than a distance between the developer bearing member and the image bearing when the frame is at the second position.

26. The image forming apparatus according to claim 25, wherein the frame receives a biasing force from a biasing member disposed between the frame and a second frame that supports the image bearing member, so as to displace the frame from the first position, where the developer bearing member is separated from the image bearing member, to the second position, where the developer bearing member contacts the image bearing member.

27. The image forming apparatus according to claim 25, wherein, when the frame is displaced such that the developer bearing member is displaced relative to the image bearing member, an amount of displacement of the filter is greater than an amount of displacement of the developer bearing member.

28. The image forming apparatus according to claim 25, wherein the frame has a third opening to expose a part of the developer bearing member to the exterior of the frame, and wherein the second opening is located at an upstream side of the third opening on a conveying path of the developer in the second chamber.

29. The image forming apparatus according to claim 28, wherein the second opening is located above the first opening, the developer bearing member, and the third opening.

30. The image forming apparatus according to claim 28, further comprising:

end seals that are disposed on both edge portions of the third opening in a longitudinal direction of the third opening; and a sealing sheet that is fixed to the frame, and contacts the developer bearing member between the end seals.

31. The unit according to claim 28 further comprising:

a supply member that is disposed in the second chamber and is configured to supply the developer to the developer bearing member by contacting the developer bearing member, wherein the second opening is located at an upstream side of the third opening and at a downstream side of the first opening with respect to a rotation direction of the supply member.

32. The image forming apparatus according to claim 24, wherein the frame includes a partition portion for partitioning the first chamber and the second chamber, and the partition portion is provided with the first opening, and wherein the conveying member is contactable to the partition portion.

33. The image forming apparatus according to claim 24, wherein the frame includes a wall provided with the second opening, the frame includes a convex portion projecting in a direction crossing the wall, the convex portion being disposed so as to surround the second opening, wherein the convex portion includes a first portion and a second portion, the first portion and the second portion extend along the direction of the rotation axis, the first portion is disposed at one side of the second opening, and the second portion is disposed at an other side of the second opening, and wherein with respect to the direction crossing the wall, a length of the convex portion is longer than a length of the filter.

34. The image forming apparatus according to claim 24, further comprising:

a pressing member configured to press the frame such that the frame is displaced between the first position and the second position.

35. The image forming apparatus according to claim 34, wherein, if the frame is positioned to the second position, and a predetermined number of the image forming operations occurs, the pressing member is moved to a third position such that the frame is moved from the second position to the first position.

36. The image forming apparatus according to claim 24, wherein the filter includes an exposed surface exposed to the interior of the second chamber, and wherein the frame is configured to be moved from the second position to the first position and be positioned at the first position after an image forming operation is performed, and wherein the filter is disposed so that an angle between the exposed surface and a horizontal line at the first position is less than an angle between the exposed surface and the horizontal line at the second position.

37. The image forming apparatus according to claim 24, further comprising:

a supply member that is disposed in the second chamber and is configured to supply the developer to the developer bearing member by contacting with the developer bearing member, wherein the conveying member is configured to convey the developer such that the developer passes above the supply member.

38. The image forming apparatus according to claim 24 further comprising:

a supply member that is disposed in the second chamber and is configured to supply the developer to the developer bearing member by contacting the developer bearing member, wherein the second opening is located directly above the supply member.

* * * * *